US006230760B1

(12) United States Patent
Di Natale et al.

(10) Patent No.: US 6,230,760 B1
(45) Date of Patent: May 15, 2001

(54) LINEAR MOTOR WEFT PRESENTING APPARATUS

(75) Inventors: Gianfranco Di Natale, Rapperswil; Beat Vollenweider, Uster, both of (CH)

(73) Assignee: Sulzer Textil AG, Rueti (CH)

( * ) Notice: Subject to any disclaimer, the term of this patent is extended or adjusted under 35 U.S.C. 154(b) by 0 days.

(21) Appl. No.: 09/483,505

(22) Filed: Jan. 14, 2000

(30) Foreign Application Priority Data

Jan. 28, 1999 (EP) ..... 99810074

(51) Int. Cl.[7] ..... D03D 47/38
(52) U.S. Cl. ..... 139/453
(58) Field of Search ..... 139/453

(56) References Cited

U.S. PATENT DOCUMENTS 4,438,791 * 3/1984 Oesterle et al. ..... 139/453
4,998,420 * 3/1991 Scavino ..... 139/453
5,090,457 * 2/1992 Corain et al. ..... 139/453
6,006,795 * 12/1999 Corain et al. ..... 139/453

FOREIGN PATENT DOCUMENTS

0347626A2 12/1989 (EP) .
0461524A1 12/1991 (EP) .
0598264A1 5/1994 (EP) .
0894883A2 2/1999 (EP) .

OTHER PUBLICATIONS

Patent Abstracts of Japan, vol. 98, No. 2, Jan. 30, 1998 & JP 09 268453 A (Toyota Autom Loom Works Ltd), Oct. 14, 1997 Abstract.

* cited by examiner

*Primary Examiner*—Andy Falik
(74) *Attorney, Agent, or Firm*—Townsend and Townsend and Crew LLP

(57) ABSTRACT

The apparatus contains a linear motor (1) with a stator (4) which has two permanent magnets (7) and with an armature (5) which has a winding (22), and a thread server finger (2) for the weft thread which is connected to the linear motor in order to present the weft thread to a rapier. The linear motor (1) and the thread server finger (2) are designed as a modular assembly.

10 Claims, 5 Drawing Sheets

1
2
4
5
6
7
8
9
11
12
13
14
15
16
17
18
21
22
23
24
25
26

LINEAR MOTOR WEFT PRESENTING APPARATUS

The invention relates to an apparatus for the presenting of a weft thread for a rapier weaving machine having a linear motor (1) with a stator (4) which together with permanent magnets and a holder interacts with an armature (5, 31) containing a winding (22) moving a thread server finger (2) and to an arrangement with an apparatus as well as to a weaving machine with an arrangement.

BACKGROUND OF THE INVENTION

An apparatus for the presenting of the weft thread for a rapier weaving machine is disclosed. The apparatus includes a linear motor (1) with a stator (4). The stator has two permanent magnets (7) and a holder (6) for the permanent magnets. An armature (5, 31) interacts with the stator and contains a winding (22). The armature is journaled at the holder (6), and has a thread serving finger (2) for the weft thread. This thread serving finger is connected to the armature of the linear motor and moves to present the weft thread to a rapier. The apparatus for the presenting of the weft thread for the rapier weaving machine is designed as a modular assembly. Provision is made to hold a number of such linear motors in side by side relationship so that any individual linear motor may be selectively removed.

SUMMARY OF THE INVENTION

The object of the invention is to improve an apparatus for the presenting of a weft thread.

This object is satisfied in accordance with the invention by the characterising features of claim 1.

Since the linear motor and the thread server finger are formed as a modular unit the manufacturing costs are reduced in an advantageous manner.

The arrangement has the advantage that the modular apparatus can be replaced simply.

BRIEF DESCRIPTION OF THE DRAWINGS

In the following the invention will be explained with reference to the accompanying drawings.

Shown are.

DESCRIPTION OF THE PREFERRED EMBODIMENTS

Figures 1, 2:
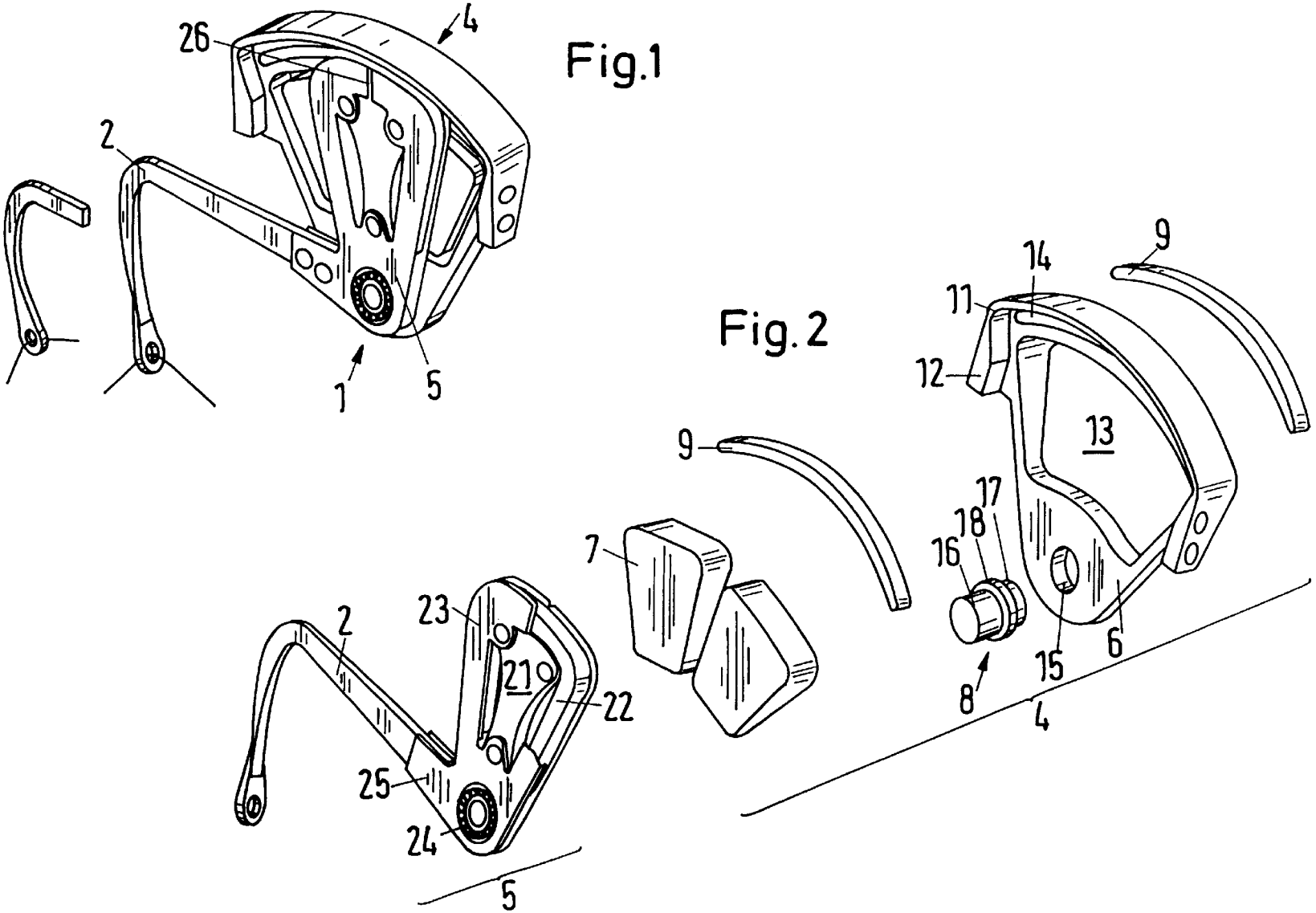
FIG. 1 is an embodiment of an apparatus in accordance with the invention in a spatial illustration.
FIG. 2 is the apparatus in accordance with FIG. 1 in a pulled apart illustration.
Figure 3:
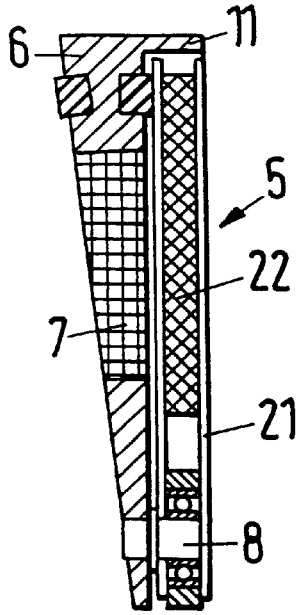
FIG. 3 is a section through the linear motor in accordance with FIG. 1.

Reference is made to FIGS. 1 to 3, which show the preferred embodiment of the apparatus. The apparatus consists essentially of a linear motor 1 and a thread server finger 2 for a weft thread. The linear motor 1 contains a stator 4 and an armature 5. As FIG. 2 shows, the stator 4 contains a holder 6, two permanent magnets 7, a bearing pin 8 for the armature 5 and two slider members 9. The holder 6 is designed as a single-pieced body and has substantially the shape of a circular sector with a V-shaped cross-section and an axially arranged extension 11 with two sections 12 for securing the holder. It has an opening 13 for the reception of the permanent magnets 7, two cut-outs 14 for the reception of the slider members 9 and a passage hole 15 for the reception of the bearing pin 8 at the centre of the circle bonding the circular sector. The holder 6 consists of a metallic material, preferably iron, or of plastic. The permanent magnets 7 are arranged in the opening 13 at a spacing from one another in such a manner that a north pole and a south pole are formed, with the space between permanent magnets being filled up with plastic. The permanent magnets 7 have a V-shaped cross-section (FIG. 3). At the ends the bearing pin 8 has in each case a cylindrical section 16, 17 and a ring-shaped section 18 with a larger diameter. The bearing pin 8 is rotationally fixedly arranged at the holder 6, and the slider members 9 are secured in the holder 6.

The armature 5 comprises a core 21, a winding 22, two side parts 23 and a roller bearing 24. The core 21 consists of plastic, e.g. of hard cloth. The side parts 23 consist of non magnetisable material, e.g. aluminium. The side parts 23 and the core 21 are connected to one another and carry the winding 22, with a heat conducting paste being provided between the winding and the side parts in order to prevent a heat stagnation or, respectively, to conduct away the heat better. The side parts 23 have a section 25 for securing the thread server finger 2 for the weft thread. The side parts 23 are separated in the upper region by a slit 26 in order to reduce the eddy current effect. The armature 5 is rotatably arranged on the bearing pin 8 in such a manner that the armature is guided, on the one hand, at the ring-shaped extension 18 of the bearing pin 8 and, on the other hand, at the slider member 9 (FIG. 3).

Figure 4:
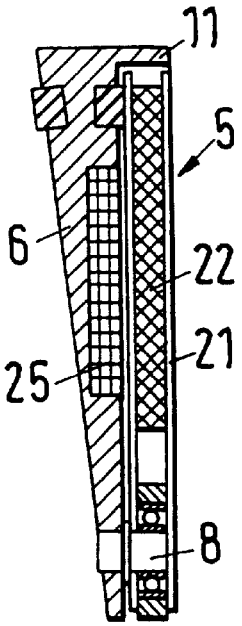
FIG. 4 is a section through another embodiment of the linear motor.

FIG. 4 shows the cross-section of a modified embodiment of a linear motor with permanent magnets 25, which however have a rectangular cross-section. In this embodiment the holder has a cut-out for the reception of the permanent magnets 25.

Figure 5:
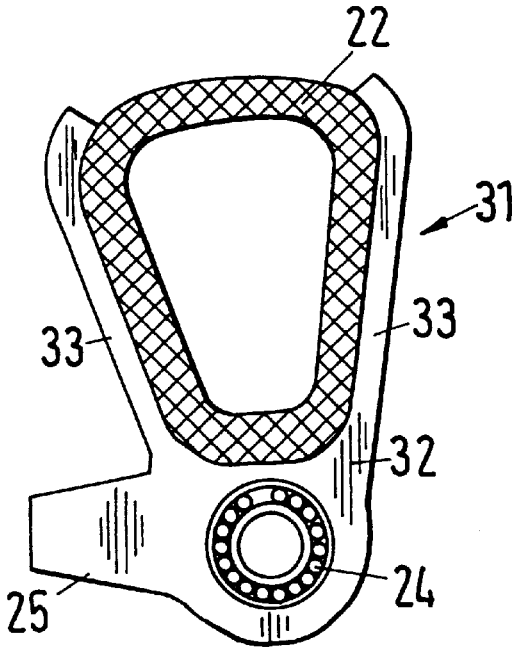
FIG. 5 is a view of another embodiment of the armature of the linear motor.

The armature 31 shown in FIG. 5 has a winding 22, a winding carrier 32 and a roller bearing 24. The winding carrier 32 has two limbs 33, between which the winding 22 is arranged, and an extension 25 for the securing of a non-illustrated thread server finger for a weft thread. The winding is connected, e.g. adhesively bonded, to the winding carrier. A spacing is provided between the ends of the limbs 33.

Figure 6:
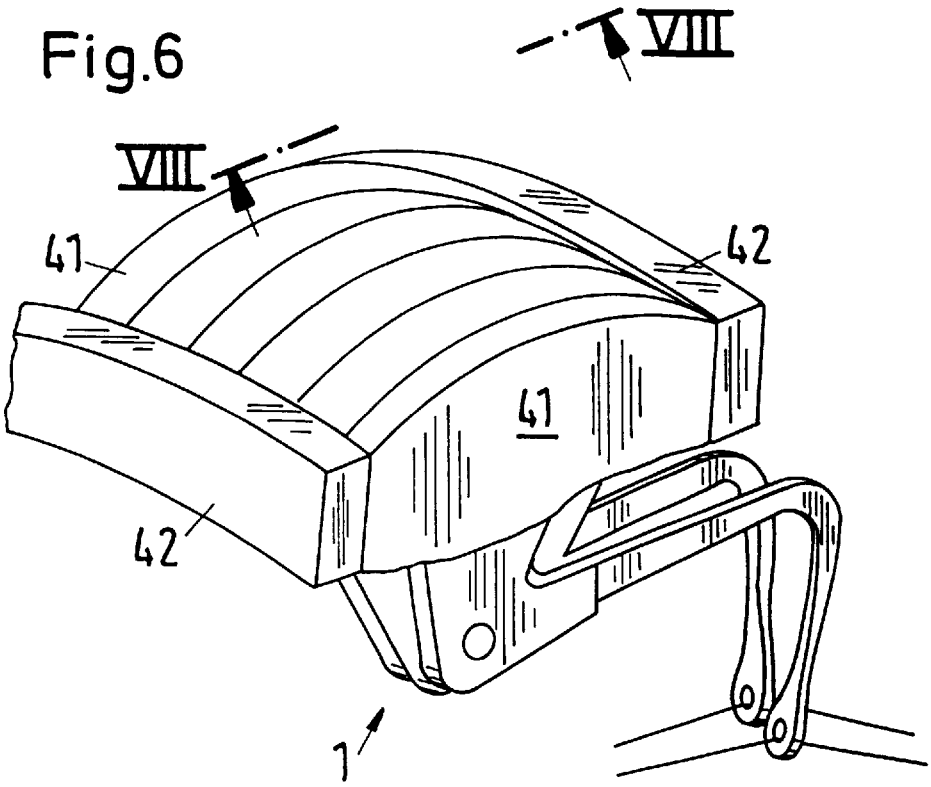
FIG. 6 is an embodiment of an arrangement in accordance with the invention for the presenting of weft threads.
Figure 7:
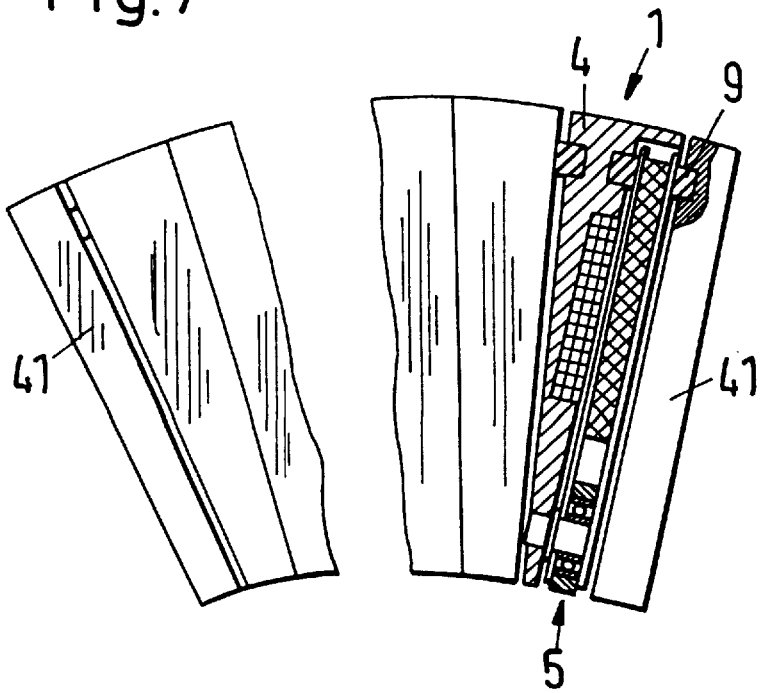
FIG. 7 is a view of the arrangement in accordance with FIG. 6 which is illustrated partly in section.

Reference is made to FIGS. 6 and 7. FIG. 6 shows an arrangement with a plurality of apparatuses for the presenting of weft threads, two plates 41 and a merely partly illustrated holder device 42. The plates close off the arrangement, on the one hand, and are intended, on the other hand, to amplify the magnetic flux passing through the arrangement. As FIG. 7 shows, the linear motors 1 are arranged to lie adjacently, with the armature 5 in each case being guided at the slider member 9 of the adjacent linear motor or at a plate 41 respectively.

Figure 8:
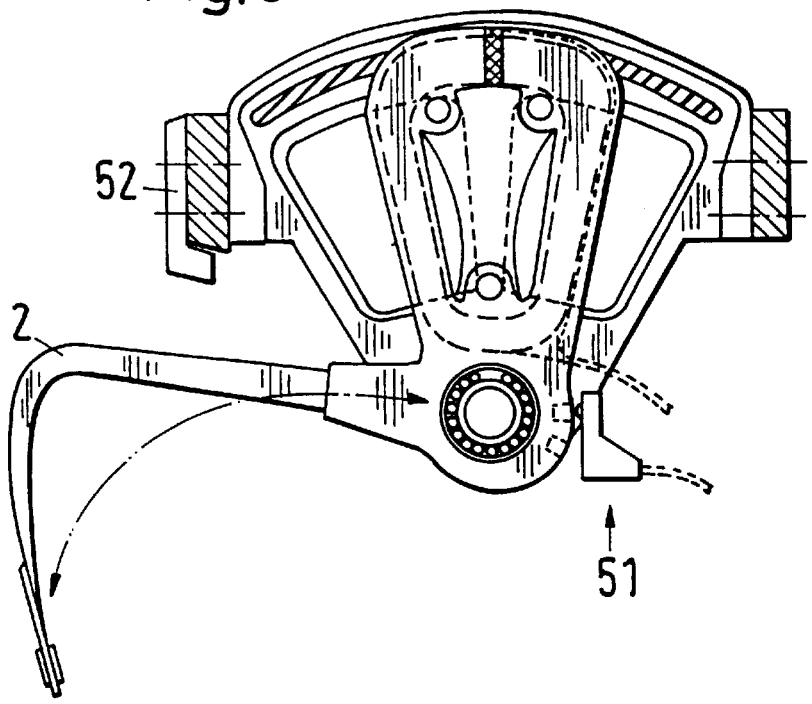
FIG. 8 is a section along the plane VIII—VIII in FIG. 6.

As FIG. 8 shows each linear motor is provided with a sensing device 51 in order to be able to control the linear motor by means of a closed control loop, and the thread server finger 2 is formed in such a manner that the force flow is conducted into the bearing pin. This arrangement is provided with an adjustable abutment member 52 in order to limit the upper pivotal position of the thread server finger 2. In addition to the abutment member 52 a second abutment member (not illustrated) can be provided in order to define the lower pivotal position of the thread server finger.

Figure 9:
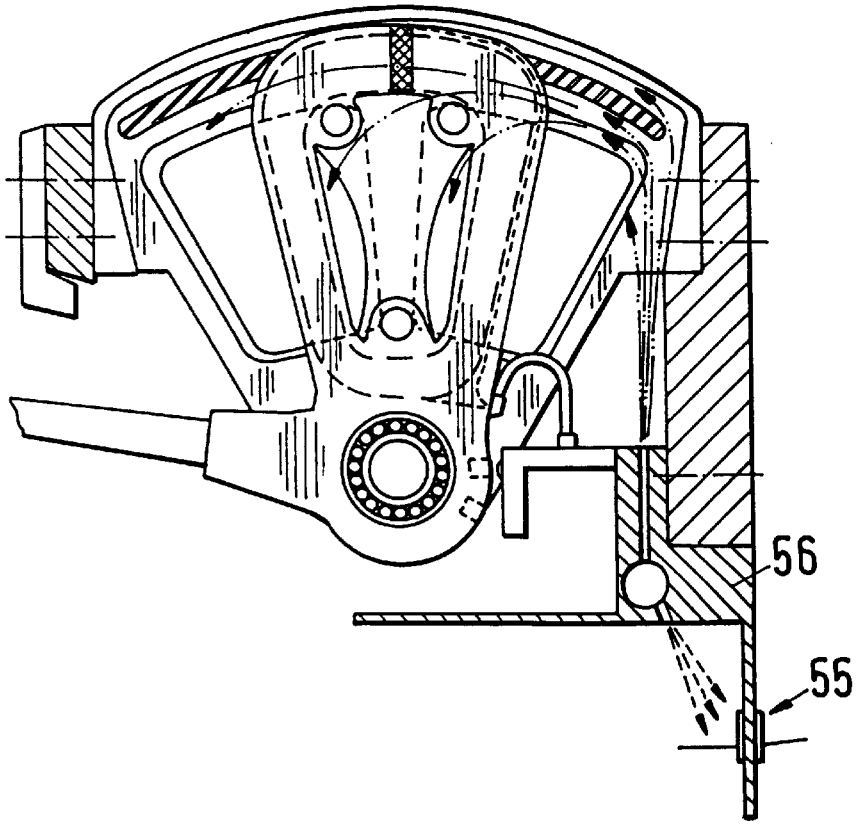
FIG. 9 is a modification of the arrangement in accordance with FIG. 6 in section.

As FIG. 9 shows, in a second embodiment of the arrangement for the presenting of a weft thread, in addition to an eye in the thread server finger 2, a second eye 55 is provided for the guiding of the weft thread and is arranged at a unit 56 for the cooling of the linear motor and for the cleaning of the second eye 55.

Figure 11:
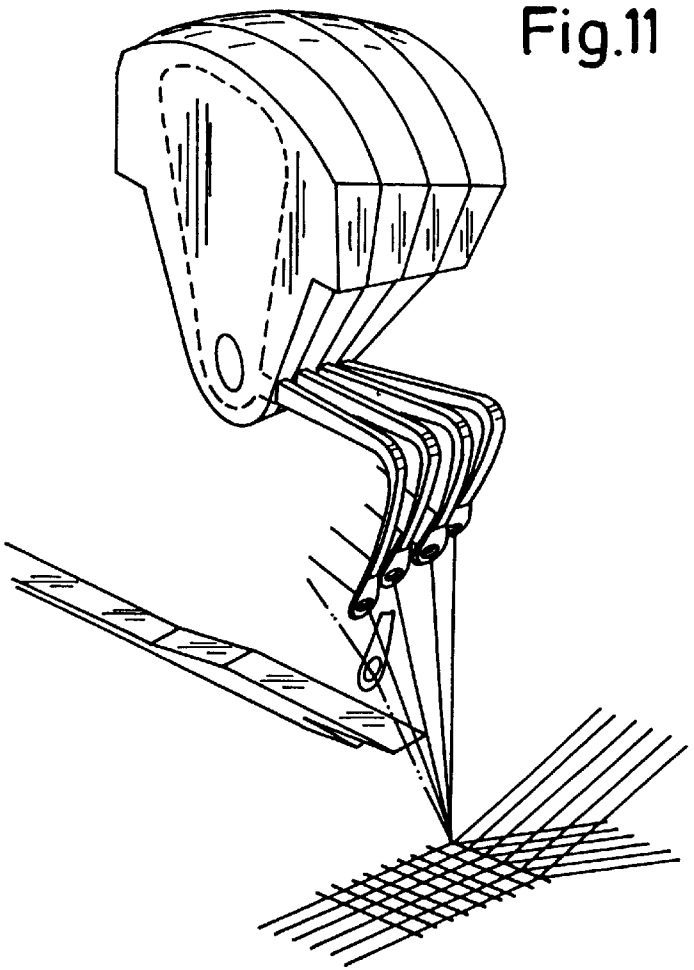
Figure 10:
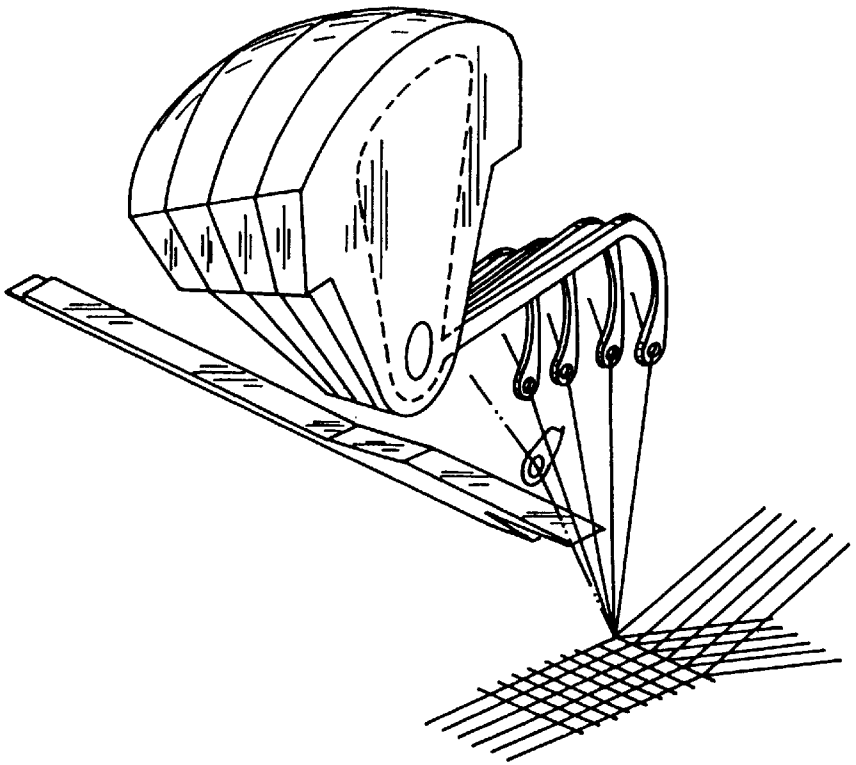
FIG. 10 is a spatial illustration of the first association of an arrangement in a rapier weaving machine and, FIG. 11 is a spatial illustration of the second association of an arrangement in a rapier weaving machine.

As FIGS. 10 and 11 show, the above described arrangement can be mounted in a rapier weaving machine either along the weft direction or the warp thread direction.

The apparatus contains a linear motor 1 with a stator 4 which has two permanent magnets 7 and with an armature 5 which has a winding 22, and a thread server finger 2 for the weft thread which is connected to the linear motor in order to present the weft thread to a rapier. The linear motor 1 and the thread server finger 2 are designed as a modular assembly.

What is claimed is:

1. Apparatus for the presenting of a weft thread for a rapier weaving machine, said apparatus comprising:

a linear motor (1) with a stator (4) and an armature (5, 31);

the stator (4) comprising two permanent magnets (7) and a holder (6) for the permanent magnets;

the armature (5, 31) having a winding (22);

the armature (5, 31) being journaled at the holder (6), and having a thread server finger (2) for the weft thread connected to the armature of the linear motor in order to present the weft thread to a rapier;

the armature (5, 31) including two frame-like side parts (23) of a nonmagnetic material which surrounds the winding (22), with the side parts being separated by a gap (26) in order to reduce the eddy current effect.

2. Apparatus for the presenting of a weft thread for a rapier weaving machine, said apparatus comprising:

a linear motor (1) with a stator (4) and an armature (5, 31);

the stator (4) comprising two permanent magnets (7) and a holder (6) for the permanent magnets;

the armature (31) having a winding (22);

the armature (31) being journaled at the holder (6), and having a thread server finger (2) for the weft thread connected to the armature of the linear motor in order to present the weft thread to a rapier; and, the armature (31) has a winding carrier (32) with two limbs (33), with a spacing between the limb ends in order to reduce the eddy current effect.

3. Apparatus for the presenting of a weft thread for a rapier weaving machine, said apparatus comprising:

a linear motor (1) with a stator (4) and an armature (5, 31);

the stator (4) comprising two permanent magnets (7) and a holder (6) for the permanent magnets;

the armature (5, 31) having a winding (22);

the armature (5, 31) being journaled at the holder (6), and having a thread server finger (2) for the weft thread connected to the armature of the linear motor in order to present the weft thread to a rapier; and, an adjustable abutment member (52) in order to limit the upper pivotal position of the thread server finger (2).

4. Apparatus for the presenting of a weft thread for a rapier weaving machine in accordance with claim 13, wherein the holder (6) has a substantially V-shaped cross-section.

5. Apparatus for the presenting of a weft thread for a rapier weaving machine in accordance with claim 3, wherein the holder (6) has an opening (13) for the reception of the permanent magnets (7).

6. Apparatus for the presenting of a weft thread for a rapier weaving machine in accordance with claim 3, wherein the holder (6) consists of iron or plastic.

7. Apparatus for the presenting of a weft thread for a rapier weaving machine in accordance with claim 3, wherein the slider members (9) for the armature (5) are arranged in the holder (6).

8. Apparatus for the presenting of a weft thread for a rapier weaving machine in accordance with claim 3 and including an adjustable abutment member (52) in order to limit the lower pivotal position of the thread server finger (2).

9. Apparatus for the presenting of weft threads for a rapier weaving machine comprising:

a holder device (42);

a plurality of modular assemblies for the presenting of welt threads, each modular assembly having a linear motor (1) with a stator (4) and an armature (5, 31), the stator comprises two permanent magnets (7) and a holder (6) for the permanent magnets, the armature (5, 31) comprises a winding (22), the armature (5, 31) journaled at the holder (6), a thread server finger (2) for the welt thread is connected to the armature in order to present the welt thread to a rapier, the stator comprises connecting means arranged with respect to the holder device (42), that each modular assembly can individually be fixed to and loosen from the holder device (42).

10. Apparatus for the presenting of weft threads for a rapier weaving machine according to claim 9 wherein the armature (5) of a linear motor (1) is guided at the adjacent linear motor.

* * * * *